US006256790B1

(12) United States Patent
Rankin

(10) Patent No.: US 6,256,790 B1
(45) Date of Patent: Jul. 10, 2001

(54) POST OPERATIVE VEST WITH PILLOW ENCLOSURE

(76) Inventor: Martha E. Rankin, 2009 PineCroft Ct., Odenton, MD (US) 21113

( * ) Notice: Subject to any disclaimer, the term of this patent is extended or adjusted under 35 U.S.C. 154(b) by 0 days.

(21) Appl. No.: 09/420,564

(22) Filed: Oct. 19, 1999

(51) Int. Cl.[7] ..... A41D 13/00
(52) U.S. Cl. ..... 2/102; 2/464
(58) Field of Search ..... 2/102, 104, 111, 2/80, 114, 463, 464, 94, 247, 267, 92, 115; 128/846, 874, 888

(56) References Cited

U.S. PATENT DOCUMENTS 3,135,961 * 6/1964 Roderick ..... 2/2
3,633,215 * 1/1972 Richards ..... 2/69.5
3,848,267 * 11/1974 DeSpain ..... 2/94
4,268,917 * 5/1981 Massey ..... 2/102
5,144,694 * 9/1992 Daoud et al. ..... 2/69
5,257,956 * 11/1993 Ewen ..... 2/102
5,325,538 * 7/1994 Schoenweiss et al. ..... 2/102
5,621,914 * 4/1997 Ramone et al. ..... 2/463
5,692,246 * 12/1997 Benedick ..... 2/463
6,012,162 * 1/2000 Bullat ..... 2/456
6,098,196 * 8/2000 Logan ..... 2/463

* cited by examiner

*Primary Examiner*—Amy B. Vanatta
(74) *Attorney, Agent, or Firm*—Alfred F. Hoyte, Jr.

(57) ABSTRACT

A post operative vest for patients recovering from abdominal surgery has front and rear panels with an opening for the patient's head. The front and rear panels are connected only at the top and ties or other fasteners extend from the sides of the panels to adjustably secure the vest about the patient's mid-section. A centrally located front pocket is sized to releasably secure a post operative surgical pillow at a position proximate the user's surgical site. The closure means allows for securing pillows of different sizes and facilitates orientation of the pillow in different positions as may be required by the patient.

5 Claims, 2 Drawing Sheets

POST OPERATIVE VEST WITH PILLOW ENCLOSURE

BACKGROUND OF THE INVENTION

The present invention relates generally to post operative garments. More particularly, it relates to an improved post operative vest which allows removable insertion of a protective pillow.

STATEMENT OF THE PRIOR ART

Various types of post operative garments and hospital gowns are known in the art. Hospital gowns typically have openings in the front, side or rear and are not particularly useful for outpatient care. Other post operative garments include immobilization garments which are typically used with immobilization devices such as casts or upper or lower body immobilization devices. These garments, while generally effective for their stated purpose, are not effective for users recovering from abdominal surgery, which requires placement of a pillow over the surgical site when the user is walking, coughing, laughing, or engaged in other physical activity which may stress the abdominal muscles thereby affecting the surgical site. While there are garments and devices which may be useful for assisting with the recovery from abdominal surgery, none of them are seen to offer the advantages of the functional features of the present invention.

U.S. Pat. No. 5,661,852 issued to Kessler discloses an orthopedic surgical shirt which can be used for the post operative stage of a treatment involving a patient's upper body. The shirt includes a number of removal panels to allow the patient to more easily dress and undress. A number of releasable fasteners allow for quickly opening the panels at strategic locations to accommodate various types of post-operative immobilization devices. The shirt has no use beyond the post operative stage. By contrast, the present invention is designed primarily for use with a post operative pillow and functions to position the pillow for convenient use as required by the patient. The device may also function as an apron which may be used by the patient after the post operative recovery period.

U.S. Pat. No. 4,601,065 issued to Sigl et al. discloses a bib which includes a single panel having a front packet which functions as a crumb catcher. By contrast, the present invention has both front and rear panels which are connected by adjustable means. The front pocket is sized to contain a surgical pillow and has a resealable fastening means for containing the pillow.

None of the above inventions and patents, taken either singly or in combination, is seen to describe the instant invention as claimed.

SUMMARY OF THE INVENTION

The present invention overcomes the disadvantages of the prior art by providing a post operative vest for patients recovering from abdominal surgery. The vest has front and rear panels with an opening for the patient's head. The front and rear panels are connected only at the top and ties or other fasteners extend from the sides of the panels to adjustably secure the vest about the patient's mid-section. A centrally located front pocket is sized to releasably secure a post operative surgical pillow at a position proximate the user's surgical site. The closure means allows for securing pillows of different sizes and facilitates orientation of the pillow in different positions as may be required by the patient.

Accordingly, it is a principal object of the invention to provide an improved post operative vest for patients recovering from abdominal surgery.

Accordingly, it is an object of the invention to provide an improved post operative vest for patients recovering from abdominal surgery which has adjustable fasteners.

It is another object of the invention to provide an improved post operative vest for patients recovering from abdominal surgery having a centrally located pocket for holding a surgical pillow.

It is another object of the invention to provide an improved post operative vest for patients recovering from abdominal surgery which allows for various orientations and positions of a pillow contained within a central pocket.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
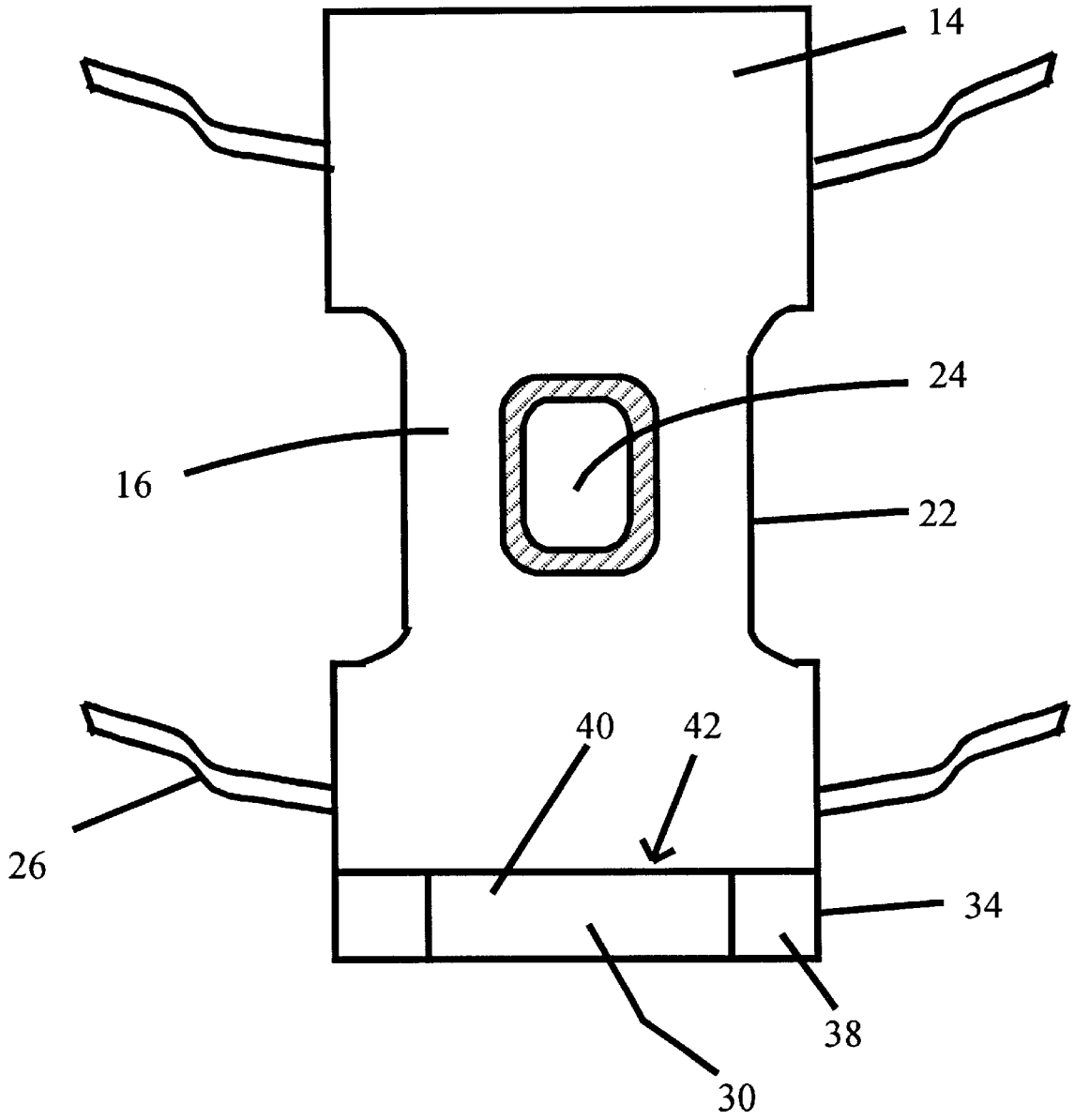
FIG. 1. is a plan view of the post operative garment of the present invention in the open condition.
Figure 2:
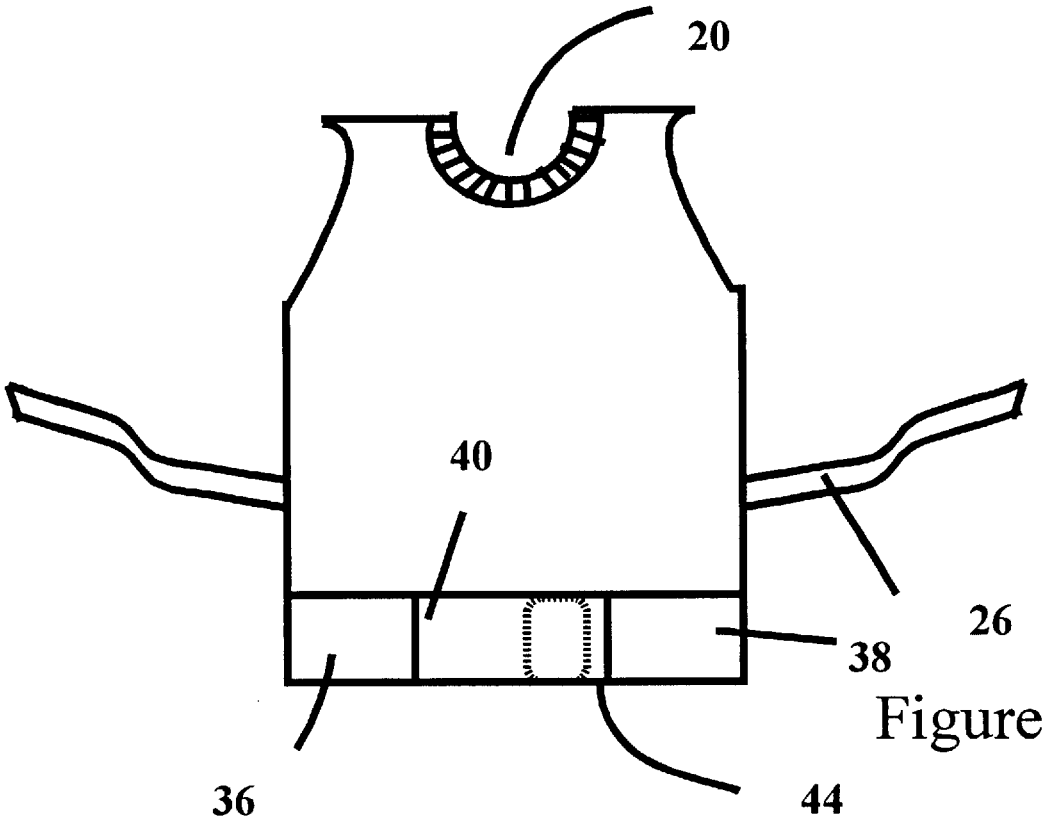
FIG. 2. is a front view, partly in section, of the post operative garment of the present invention.
Figure 3:
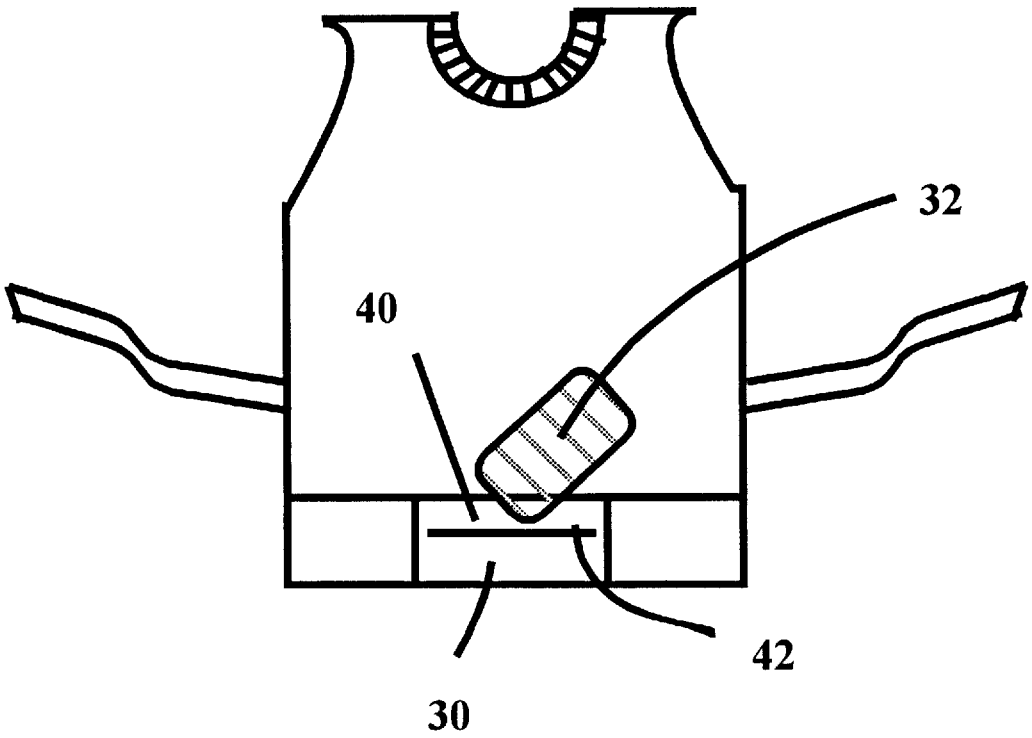
FIG. 3. is an exploded view of the post operative garment of the present invention.

Referring now to FIGS. 1–3, the garment of the present invention, a post operative surgical vest, generally indicated by the numeral 10, is shown. The garment 10, has particular application as a post operative surgical garment, which enables patients recovering from abdominal surgery to support and position a surgical pillow over a surgical site without using their hands.

The garment 10 comprises front 12 and rear 14 panels which are stitched together or otherwise attached at their top ends 16, 18. Each of the top ends 16, 18 has three cutouts 20, 22, 24, two of which 20, 22 are mutually opposed and disposed on either side of the top ends thereby forming openings for the patient's arms. Cutouts 20 form a head and neck opening which allow a patient's head and neck to pass through. The garment 10 preferably comes in at least four sizes, corresponding to small, medium, large and extra large. Child sizes and extremely large sizes may also be provided.

Front 12 and rear 14 panels are secured about the patient by 2 pairs of fasteners 26 which may be ties. Alternatively, the fasteners 26 may have velcro strips (not shown) secured thereto to facilitate quick and easy attachment for patient's with arthritis or other impediments.

A pocket 30 adapted to hold a post surgical pillow 32 is positioned in the bottom portion 34 of the front 12 panel. Pockets 36, 38 formed on either side of pocket 30 may be used by the patient in lieu of pockets in the garments under the vest 10 which may be rendered inaccessible when the vest 10 is secured about the patient. The pocket 30 includes a closure 40 which co-extends across the entire opening 42 of the pocket. This co-extending closure arrangement ensures that the pillow 32 remains soil free. In order to ensure that the pillow 32 is correctly positioned over the surgical site, the vest 10 may be made with additional pockets (not shown) which are also formed with co-extending closures. In a preferred embodiment, vests 10 designated as being for use for patients of a particular size recovering from a specific type of abdominal surgery. For instance, a vest for a large patient recovering from appendix removal may be correspondingly large and have and an appropriately located pocket. The closure 40 may be velcro, a zipper, or other type of co-extending type re-usable closure.

The pillow 32 is a post operative surgical pillow which are commercially available from medical supply outlets and pharmacies. Pillow 32 is preferably chosen to fit snugly into the pocket. Preferably, vests 10 are fabricated with pocket openings 42 and interior dimensions corresponding to commonly available pillow sizes. It can be appreciated that pillows 32 will generally be rectangular, thus the closure 42 will allow for orientation of the pillow 32 in a horizontal or vertical position. This allows a user to choose a relatively small pillow 32 for insertion into either side of the pocket 30, with the short end parallel to the bottom edge 44 of the front panel 12 as may be seen more clearly in FIG. 2.

In use, the patient slips the garment 10 over his head by placing his head and neck into and through opening 20 until the top ends 16, 18 are resting on his shoulders. The patient then secures the vest 10 about his body using the fasteners 26. The pillow 32 is then inserted into the pocket 30, oriented as necessary to properly cover the wound or surgical site. When the user is walking, laughing, coughing, or engaging in other activity which may stress the wound, he may then press upon the pillow 32 as required.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A post operative vest comprising:

front and rear panels, both said front and rear panels having fastening means extending from mutually opposed side portions;

said front panel having a bottom portion with a bottom edge and a center region extending from said bottom edge to a top portion;

a central pocket formed in said bottom portion within said center region said central pocket having an opening and a closure means therefor;

at least one cushioning means containable within said central pocket, said at least one cushioning means sized to allow for positioning at a desired position within said central pocket.

2. The vest of claim 1 wherein said at least one cushioning means is substantially rectangular and may be oriented horizontally or vertically within said central pocket.

3. The vest of claim 1 wherein at least one additional pocket is formed in said front panel, each of said additional pockets having a co-extending closure means.

4. The vest of claim 1 wherein said closure means is co-extensive with said opening.

5. The vest of claim 1 wherein said central pocket is positioned in accordance with the position of a patient's surgical scar.

* * * * *